US005086547A

United States Patent [19]

Ziemelis

[11] Patent Number: 5,086,547

[45] Date of Patent: Feb. 11, 1992

[54] BOX AND CATCH ASSEMBLY FOR BRACELETS, NECKLACES, ETC.

[75] Inventor: Herbert Ziemelis, Wallingford, Conn.

[73] Assignee: The Napier Company, Meriden, Conn.

[21] Appl. No.: 529,331

[22] Filed: May 29, 1990

[51] Int. Cl.[5] ..... A44B 17/00

[52] U.S. Cl. ..... 24/615; 24/616

[58] Field of Search ..... 24/615, 616, 618, 116 A, 24/573.3, 589, 598.1, 612, 499, 238, 336; 63/4

[56] References Cited

U.S. PATENT DOCUMENTS

| | | | |
|---|---|---|---|
| 217,857 | 5/1887 | Forstner | 24/230 |
| 711,826 | 10/1902 | Collins | 24/616 |
| 889,230 | 6/1908 | Hoffman | 24/616 |
| 956,149 | 4/1910 | Nordlund | 24/612 |
| 1,326,055 | 12/1919 | Hirsch | 24/616 |
| 1,421,388 | 7/1922 | Bippart | 24/616 |
| 1,441,999 | 1/1923 | Posner | 24/616 |
| 2,986,792 | 6/1961 | Wyatt | 24/616 |
| 3,412,576 | 11/1968 | Hodge | 63/4 |
| 4,426,854 | 1/1984 | Geldwerth et al. | 63/4 |
| 4,520,537 | 6/1985 | Valikov | 24/116 A |
| 4,590,649 | 5/1986 | Neilson, Jr. | 24/615 |

FOREIGN PATENT DOCUMENTS

| | | | |
|---|---|---|---|
| 1398165 | 3/1965 | France | 24/616 |
| 17823 | of 1906 | United Kingdom . | |
| 217756 | 6/1924 | United Kingdom . | |

*Primary Examiner*—Victor N. Sakran
*Attorney, Agent, or Firm*—Hayes & Reinsmith

[57] ABSTRACT

A jewelry clasp having a catch box and a catch insertable into the catch box to a locked position releasably joining the catch and the catch box. A resiliently deformable interlocking segment of the catch engages a locking member of the box in a locked position. A tab is formed on the interlocking segment for engagement with a human finger to unlock the catch and catch box.

1 Claim, 3 Drawing Sheets

BOX AND CATCH ASSEMBLY FOR BRACELETS, NECKLACES, ETC.

FIELD OF THE INVENTION

This invention relates generally to jewelry clasps and more particularly to jewelry clasps of a type having an catch receivable within an interlocking catch box.

BACKGROUND OF THE INVENTION

Jewelry clasps are used for interconnecting free ends of necklaces, chains, braclets and similar type jewelry. A large variety of clasps have been developed in an attempt to provide a clasp that is both aesthetically pleasing while being strong and secure. However, the locking of a jewelry clasp is a delicate operation given the nature of the small and intricate parts involved, and ultimately, many jewelry clasps loose their locking ability or break due to fatigue of the material, thereby rendering the corresponding jewelry piece useless.

OBJECTS OF THE INVENTION

It is therefore an object of the invention to provide an improved jewelry clasp which is strong and durable while being low in cost and easy to fabricate.

It is another object of the invention to provide a jewelry clasp which is aesthetically pleasing.

It is a further object of the invention to provide a jewelry clasp which securely and reliably fastens its jewelry piece.

It is another object of the invention to provide a jewelry clasp that is economical to manufacture, comprised of a minimum number of parts and is quick and easy to use repeatedly and reliably over an extended period of time.

Other objects will be in part obvious and in part pointed out in more detail hereinafter.

A better understanding of the objects, advantages, features, properties and relations of the invention will be obtained from the following detailed description and accompanying drawings which sets forth an illustrative embodiment and is indicative of the various ways in which the principle of the invention is employed.

SUMMARY OF THE INVENTION

A jewelry clasp constructed according to the present invention comprises, in its preferred emboliment, a catch, having a pair of opposed segments insertable into a catch box to a locked position releasably joining the catch and the catch box; one of the catch segments is resiliently deformable and is comprised with an interlocking member for interlocking engagement with a locking member of the catch box in the locked position.

In further accord with the invention, a tab may be formed on the resiliently deformable catch segment, the tab being engageable with a human finger for compressing the resiliently deformable segment towards the other segment thereby disengaging the interlocking member and locking member.

In still further accord with the invention, a graduated surface may be formed on the resiliently deformable segment for compressing the resiliently deformable segment towards the other segment during insertion of the catch into the catch box.

DETALIED DESCRIPTION OF A PREFERRED EMBODIMENT

The present invention comprises a jewelry clasp for fastening the ends of a piece of jewelry, such as a neckless, braclet, or watch, that is strong and durable, comprised of a minimum number of parts and quick and easy to use repeatedly and reliably over an extended period of time.

Referring in detail to the drawings, the jewelry clasp of this invention is generally indicated by numeral 10 and comprises a catch box 11 and an interlocking catch 12, insertable into and easily removeable from the catch box 11.

Figure 2:
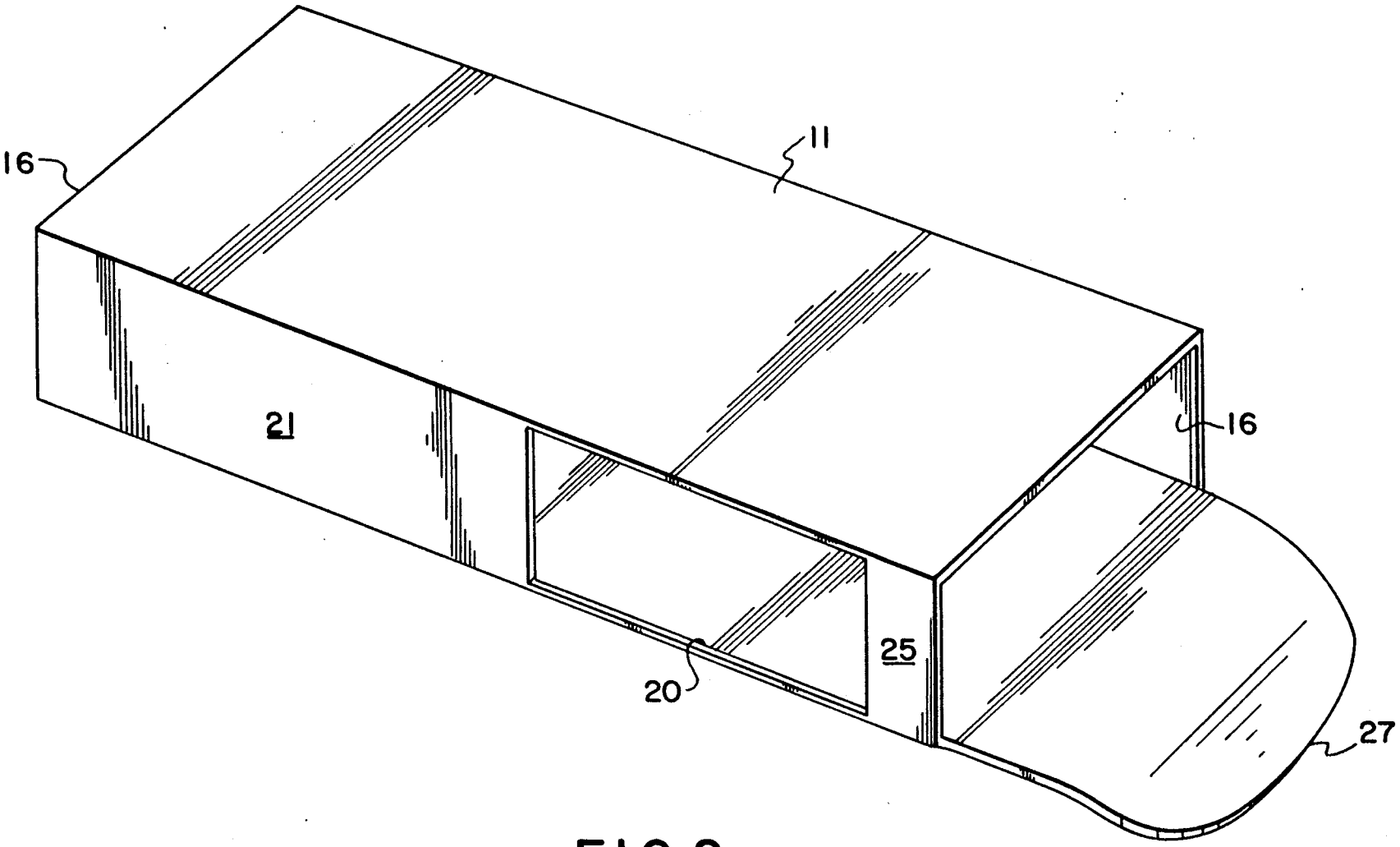
FIG. 2 is a perspective view of a catch box of the jewelry clasp of FIG. 1.

In FIG. 2, the catch box 11 is shown as being a generally elongated rectangle in shape, a first and second end of the box 15, 16 being open. A slot 20 is formed in a side 21 of the box. The slot 20 is formed near the second open end 16 of the box such that a locking member 25 is defined in the side of the box 21 between the slot 20 and the second open and 16.

An angled shelf 27 is integrally formed at the second open end of the box 16. The shelf 27 guides the interlocking catch 12 (FIG. 1) into the second open end 16 when inserted for joining the ends of a jewelry piece.

Figure 3:
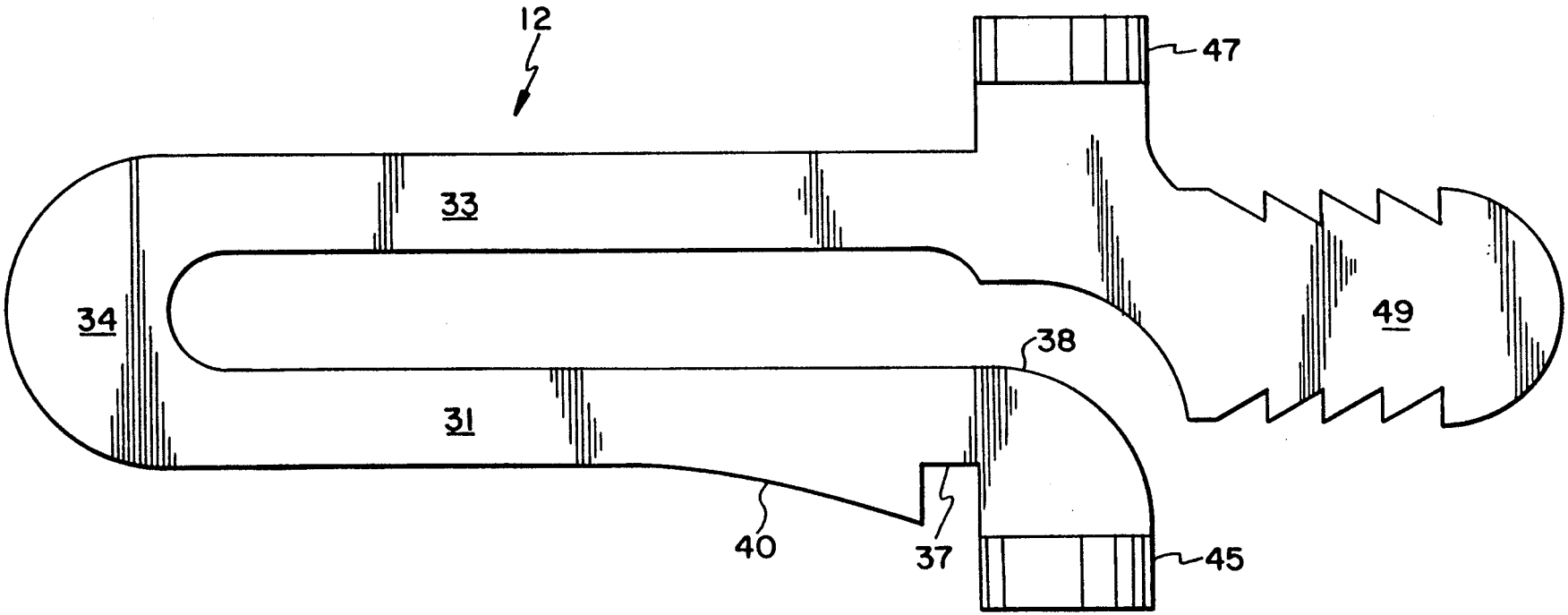
FIG. 3 is a top view of a catch of the jewelry clasp of FIG. 1.

The interlocking catch 12 of the invention is particularly well suited to provide secure, interlocking engagement with the catch box 11 over an extended period of use. More particularly, the catch is illustrated in FIG. 3, and comprises an interlocking segment 31 held in generally parallel relation to a resilient supporting segment 33 by a resiliently deformable U-shaped segment 34. The three segments 31, 33, 34 of the catch are integrally formed, the U-shaped segment 34 being resiliently deformable to allow the interlocking segment 31 to be compressed against the supporting segment 33 with the force of human fingers. When force is no longer exerted on the segments, the U-shaped segment resumes its relaxed position, acting like a spring to return the interlocking segment 31 to its original position prior to compression.

The interlocking segment 31 has a notch 37 formed in an end 38 of the segment for receiving the catch box locking segment 25. Additionally, the interlocking segment gradually increases in width in a graduated portion 40 between the U-shaped segment and the notch 37.

Figure 1:
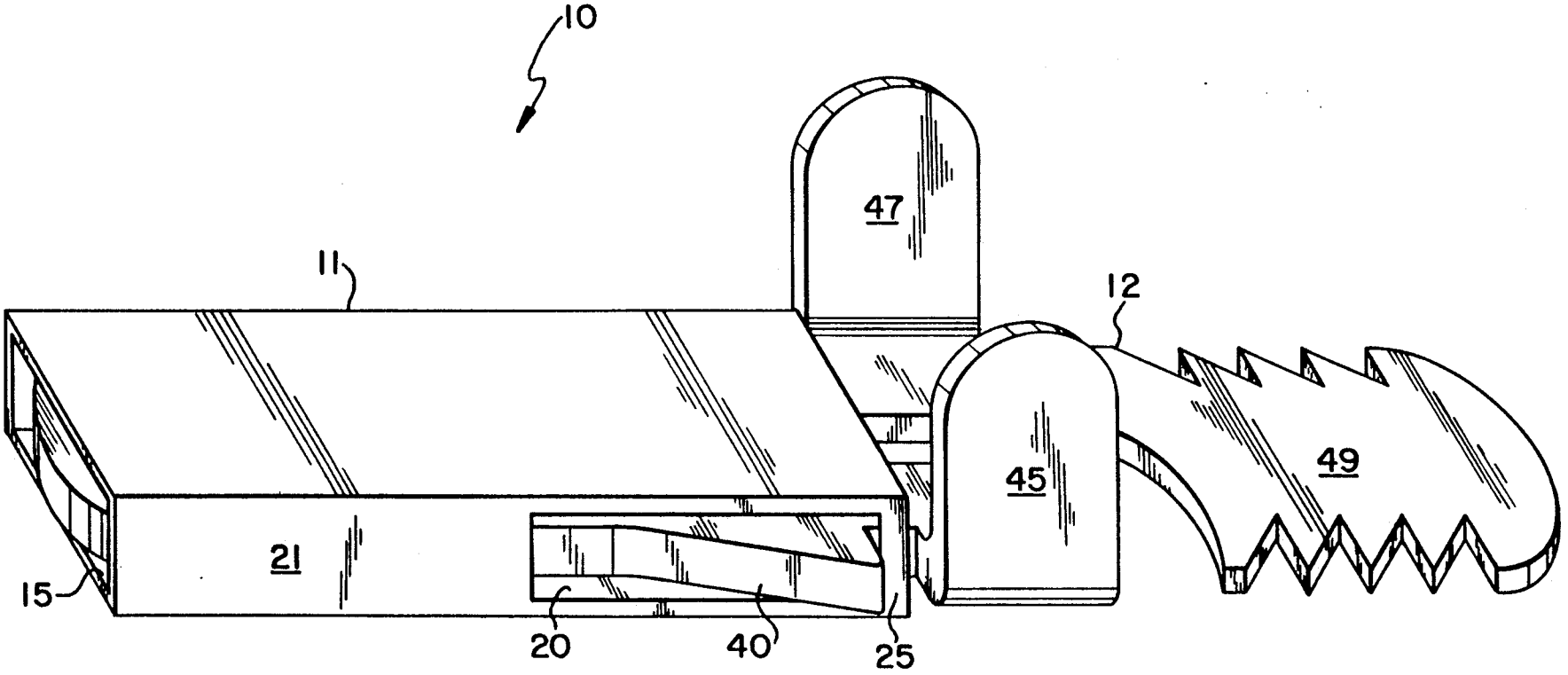
FIG. 1 is a perspective view of the jewelry clasp of the present invention.

In accordance with the teaching of this invention, the catch 12 is easily and securely engagable with the cath box 11. More particularly, as shown in FIGS. 1, 2 and 3, the U-shaped segment 34 may be guided into the second open end 16 of the catch box 11 by the angled shelf 27. As the catch is inserted into the box, the graduated portion 40 of the interlocking segment engages with the locking member 25 while the support segment 33 engages with the side of the box opposing the slot 20, and the interlocking segment is gradually compressed against the supporting segment by the graduated portion 40. The U-shaped segment 34 spring returns the interlocking segment 31 to its relaxed position when the locking member 25 is aligned with, and received in the notch 37 and the graduated portion 40 of the interlocking segment 31 is received in the slot 20. The support segment 33 remains in engagement with the side of the box opposing the slot 20, and the spring force of the U-shaped segment securely maintains the locking member 25 engaged with the notch 37.

A further aspect of the invention is the ease with which the catch may be disengaged from the box. In particular, a first tab 45 is formed in the interlocking segment 31 adjacent to the notch 37, and a second tab 47 is formed in the support segment 33 opposing the first tab 45. The tabs 45, 47 are generally semicicular in shape and perpindicular to the catch segments. The tabs may be compressed with the force of human fingers, thereby compressing the interlocking segment 31 toward the support segment 33 and disengaging the locking member 25 from the notch 37 for withdrawing the catch 12 from the catch box 11.

To effect a clasp of the structural integrity in the aforedescribed simplistic design, the catch and the box are manufactured of a suitably strong and durable metal, such as a gold or silver alloy, or other suitable metals such as brass or nickel, capable of being coated with a decorative metal coating. The box and the catch may be joined to the ends of the jewelry piece by a suitable adheasion process such as welding or adhesion with a high strength epoxy. In addition, as illustrated in FIG. 3, the support segment 33 may be integrally formed with a mounting segment 49, the mounting segment providing a large surface area for joining the catch to an end of a jewelry piece.

Although the invention has been illustrated and described with respect to an exemplary embodiment thereof, it should be understood by those skilled in the art that various other changes, omissions and additions may be made therein and thereto, without departing from the spirit and scope of the invention.

I claim:

1. A clasp for joining first and second selectively separable ends of a piece of jewelry or the like, comprising:

a catch box secured to the first end of the jewelry, said box having a locking aperture in a side wall member of said catch box;

a catch secured to the second end of the jewelry, said catch being insertable in said catch box to a locked position releasibly joining said catch and catch box, said catch having a pair of opposed segments joined at one end, at least one of said segments being resiliently deformable toward the other segment for releasably engaging with the catch box in said locked position with deformation being limited to spacing between the segments;

an interlocking projection member formed on said one resiliently deformable catch segment, said catch segment interlocking projection cooperating with said locking member to project into the aperture on said catch box to maintain said catch and catch box in said locked position; and a pair of opposed upstanding tabs integrally formed on said catch segments, said tabs extending generally perpindicular to the direction of catch insertion and removal for manual engagement by the user to compress one segment towards the other for disengaging said interlocking projection from the aperture in said locking member for unlocking said catch and said catch box.

* * * * *